US012674261B2

(12) United States Patent
Hsiao et al.

(10) Patent No.: US 12,674,261 B2
(45) Date of Patent: Jul. 7, 2026

(54) MANUFACTURING METHOD OF ABRASION RESISTANT MESH FABRIC AND ABRASION RESISTANT MESH FABRIC MADE BY THE MANUFACTURING METHOD

(71) Applicant: TIONG LIONG INDUSTRIAL CO., LTD., Taichung City (TW)

(72) Inventors: Hung-Kai Hsiao, Taichung City (TW); Chien-Hua Yeh, Taichung City (TW); Yi-Sheng Wang, Taichung City (TW)

(73) Assignee: TIONG LIONG INDUSTRIAL CO., LTD., Taichung City (TW)

( * ) Notice: Subject to any disclaimer, the term of this patent is extended or adjusted under 35 U.S.C. 154(b) by 632 days.

(21) Appl. No.: 18/179,770

(22) Filed: Mar. 7, 2023

(65) Prior Publication Data

US 2024/0191414 A1 Jun. 13, 2024

(30) Foreign Application Priority Data

Dec. 7, 2022 (TW) ..... 111147024

(51) Int. Cl.
*D06B 1/14* (2006.01)

(52) U.S. Cl.
CPC ..... *D06B 1/141* (2013.01); *D10B 2401/063* (2013.01); *D10B 2401/10* (2013.01)

(58) Field of Classification Search
CPC ..... D06B 1/141; D10B 2401/063; D10B 2401/10
See application file for complete search history.

(56) References Cited

U.S. PATENT DOCUMENTS 3,846,156 A * 11/1974 Seibert et al. ..... D06N 3/0052 427/354
2016/0271643 A1* 9/2016 Munoz ..... B05B 9/002

* cited by examiner

*Primary Examiner* — Lynda Salvatore
(74) *Attorney, Agent, or Firm* — MUNCY, GEISSLER, OLDS & LOWE, P.C.

(57) ABSTRACT

A manufacturing method of an abrasion resistant mesh fabric includes the following steps: a) arranging a gel applying mechanism, the gel applying mechanism having a gel applying roller, and a drive roller and a scraper, which are located by two opposite sides of the gel applying roller respectively and arranged separately from the gel applying roller, polyurethane gel being stored between the scraper and the outer surface of the gel applying roller in a contact manner with the outer surface of the gel applying roller; b) conveying a mesh fabric base material to pass between the gel applying roller and the drive roller in a way that the polyurethane gel clinging to the gel applying roller is applied to one side of the mesh fabric base material; and c) moisture hardening the polyurethane gel applied on the side of the mesh fabric base material at room temperature.

5 Claims, 5 Drawing Sheets

MANUFACTURING METHOD OF ABRASION RESISTANT MESH FABRIC AND ABRASION RESISTANT MESH FABRIC MADE BY THE MANUFACTURING METHOD

BACKGROUND OF THE INVENTION

1. Field of the Invention

The present invention relates to processing methods for mesh fabrics and more particularly, to a processing method for forming an abrasion resistant mesh fabric by applying resin, such as polyurethane, to a mesh fabric and hardening and curing it.

2. Description of the Related Art

Mesh fabrics have the light, thin and breathable characteristics, presently used widely in various kinds of shoes, clothing, hats, backpacks and other products. Besides, according to the requirements of different products, the manufacturers made the mesh fabrics conforming to the characteristics of the products. Taking the mesh fabric for the application to the vamp of the shoe as an example, after the user wears the shoes for a period of time, the motion of the feet causes the mesh fabric repeated pulls and outside friction, making the mesh fabric worn or torn, thereby lowering the protection and supporting function of the shoes and even affecting the appearance of the shoes.

For solving the above-described problem that the mesh fabric is insufficient in robustness for repeated pulls and worn by the friction with foreign objects, the manufacturer adds a process after the manufacture of the mesh fabric is accomplished to coat the mesh fabric with resin, making the mesh fabric relatively more robust in structure. The traditional methods of coating the mesh fabric with resin may be basically divided into two kinds, one of which is directly roller coating the mesh fabric with liquid gel, such as resins like acrylic, ethylene/vinyl acetate copolymer and so on, by a roller, and the other is making the mesh fabric pass an impregnation tank filled with liquid gel to immerse the entire mesh fabric in the gel to make the mesh fabric fully impregnated with the gel.

Although the above-described methods both combine the liquid gel with the mesh fabric, and then make the mesh fabric and gel completely dried and cured by baking, they both cause the mesh fabric the problems of color change, reduced color fastness, and hardened structure of the mesh fabric. In particular, the baking process even further intensifies the aforementioned damages to the mesh fabric, and meanwhile increases the energy consumption, thereby raising the manufacturing cost.

SUMMARY OF THE INVENTION

The present invention has been accomplished in view of the above-noted circumstances. It is a primary objective of the present invention to provide a manufacturing method of an abrasion resistant mesh fabric, wherein the abrasion resistant mesh fabric made by this method is increased in robustness without being baked, and little affection on the color fastness of the abrasion resistant mesh fabric is brought.

To attain the above objective, the present invention provides a manufacturing method of an abrasion resistant mesh fabric, which includes the following steps: a) arranging a gel applying mechanism, the gel applying mechanism having a rotatable gel applying roller, a drive roller located by one side of the gel applying roller and arranged separately from the gel applying roller, and a scraper roller located by another side of the gel applying roller and arranged separately from the gel applying roller, the scraper roller having a scraper facing an outer surface of the gel applying roller, polyurethane gel being stored between the scraper and the outer surface of the gel applying roller in a contact manner with the outer surface of the gel applying roller; b) conveying a mesh fabric base material to pass between the gel applying roller and the drive roller in a way that the polyurethane gel clinging to the gel applying roller is applied to one side of the mesh fabric base material; and c) moisture hardening the polyurethane gel applied on the side of the mesh fabric base material at room temperature to form the abrasion resistant mesh fabric.

By the above-described technical features of applying the polyurethane (PUR) gel to the side of the mesh fabric base material and under the environmental temperature and humidity conditions, curing and hardening the polyurethane gel under the moisture at room temperature, the abrasion resistant mesh fabric made in this way doesn't need to be baked in the oven, and the increased robustness of the abrasion resistant mesh fabric is still attained. Meanwhile, the energy saving and carbon reduction is also attained, and little affection on the color fastness of the abrasion resistant mesh fabric is brought, hardly affecting the presentation of the original color of the abrasion resistant mesh fabric.

Preferably, in the step c), the mesh fabric base material applied with the polyurethane gel is set still in an environment with a temperature ranged between 10° C. and 45° C. and a relative humidity ranged between 40% and 95% for at least 18 hours, and more preferably set still for at least 24 hours. Such manner can ensure the curing and hardening of the polyurethane gel applied on the side of the mesh fabric base material.

Preferably, the outer surface of the gel applying roller has a plurality of dimples. The dimples are helpful for making the polyurethane gel cling to the outer surface of the gel applying roller relatively more easily and in contact with the scraper, so as to ensure even more uniform thickness of the polyurethane gel clinging to the outer surface of the gel applying roller.

Preferably, the scraper roller has a main body, the scraper is formed on the outer surface of the main body along the axis of the main body, and the length of the scraper corresponds to the length of the gel applying roller. In this way, the polyurethane gel clinging to the outer surface of the gel applying roller can be evenly scraped in a whole surface manner by the scraper, so that the overall thickness of the polyurethane gel is maintained uniform.

Preferably, the mesh fabric base material is rolled on a feeding roller, and driven by the drive roller to be conveyed to pass between the gel applying roller and the drive roller. In this way, when the drive roller drives the mesh fabric base material to be conveyed forward, the mesh fabric base material is maintained with a certain tension, which is helpful for applying the polyurethane gel to the side of the mesh fabric base material uniformly.

On the other hand, the present invention provides an abrasion resistant mesh fabric, which is made by the above-described manufacturing method. The abrasion resistant mesh fabric includes the aforementioned mesh fabric base material and a polyurethane gel layer. The mesh fabric base material includes a plurality of warp yarns, a plurality of weft yarns, and a plurality of holes and a plurality of nodes, which are formed by the interlacing of the warp yarns and the weft yarns. The polyurethane gel layer covers one side of each of the warp yarns, the weft yarns and the nodes.

By the above-described technical features, the abrasion resistant mesh fabric provided by the present invention is increased in its own structural robustness, so that the abrasion resistant mesh fabric is uneasy to be torn.

Preferably, the size of each of the holes of the mesh fabric base material is larger than the diameter of each of the warp yarns and the weft yarns of the mesh fabric base material. In this way, the mesh fabric base material has relatively higher breathability.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The manufacturing method of an abrasion resistant mesh fabric and the abrasion resistant mesh fabric made by the manufacturing method of the present invention will be further specified by the embodiment given herein below and the accompanying drawings, and wherein.

DETAILED DESCRIPTION OF THE INVENTION

Figure 1:
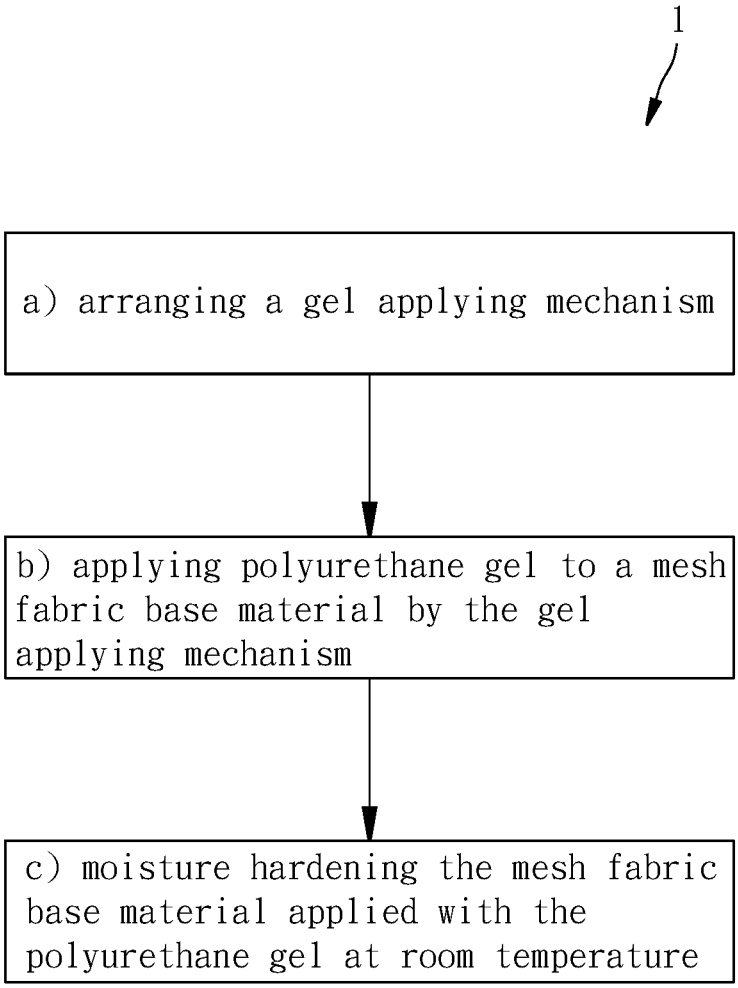
FIG. 1 is a flow chart showing the steps of a manufacturing method of an abrasion resistant mesh fabric according to a preferred embodiment of the present invention.
Figure 2:
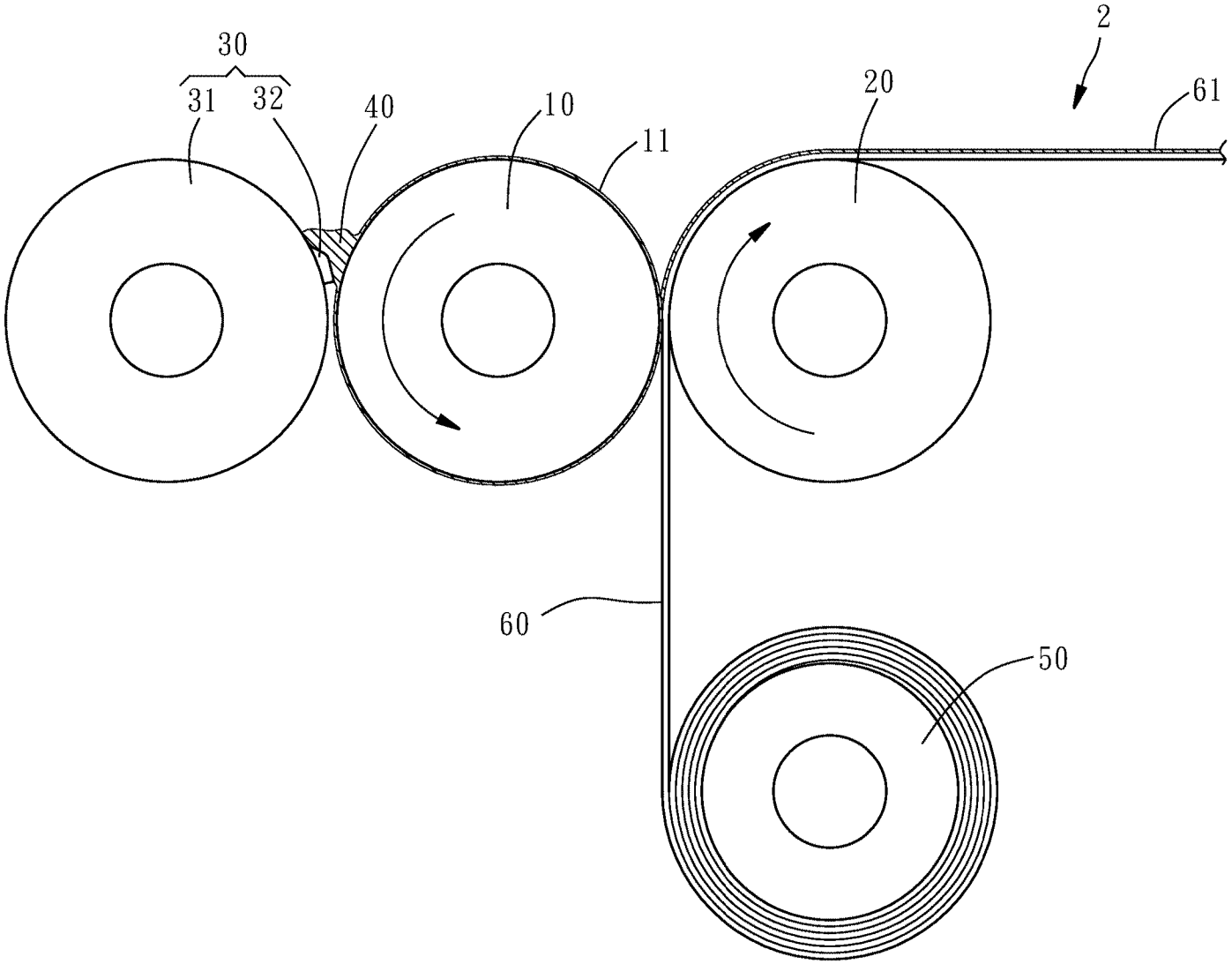
FIG. 2 is a schematic view showing the arranged relation between members of a gel applying mechanism, wherein a mesh fabric base material is rolled on a feeding roller and driven by a drive roller to be conveyed to pass between a gel applying roller and the drive roller.
Figure 3:
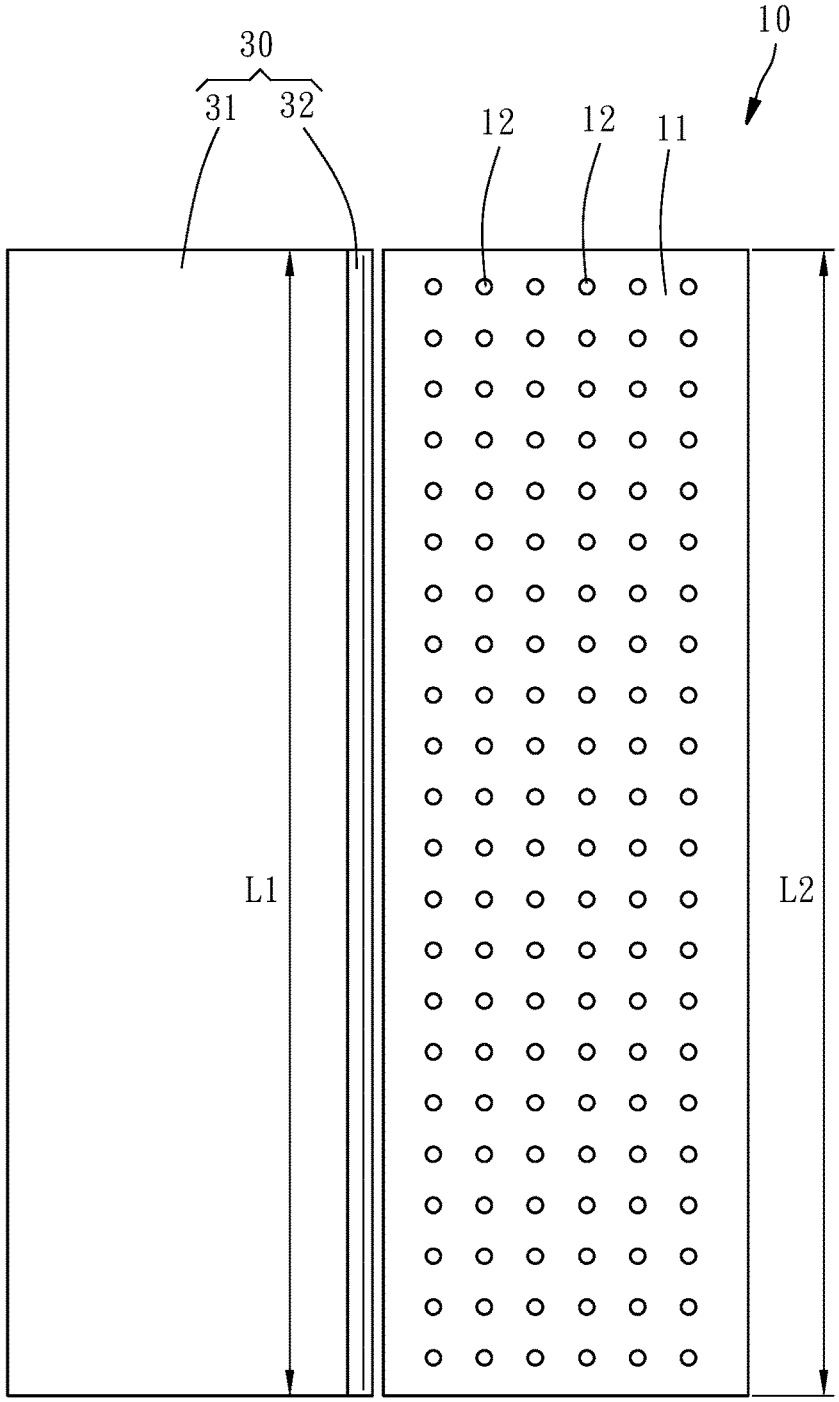
FIG. 3 is a partially enlarged schematic top view of the gel applying mechanism, showing that a scraper roller is separately disposed by a left side of the gel applying roller.

For specifying the technical features of the present invention, a preferred embodiment and the accompanying drawings are given herein below. Referring to FIG. 1, a manufacturing method 1 of an abrasion resistant mesh fabric according to a preferred embodiment of the present invention primarily includes the following steps: a) arranging a gel applying mechanism, b) applying polyurethane gel to a mesh fabric base material by the gel applying mechanism, and c) moisture hardening the mesh fabric base material applied with the polyurethane gel at room temperature. Referring to FIG. 2 and FIG. 3, the aforementioned steps a) to c) will be specified herein below.

The aforementioned step a) of arranging a gel applying mechanism is primarily arranging a gel applying mechanism 2 in a processing place. The gel applying mechanism 2 has a rotatable gel applying roller 10, a drive roller 20 located by the right side of the gel applying roller 10 and arranged separately from the gel applying roller 10, and a scraper roller 30 located by the left side of the gel applying roller 10 and arranged separately from the gel applying roller 10. The outer surface 11 of the gel applying roller 10 has a plurality of dimples 12. The scraper roller 30 has a main body 31 and a scraper 32 facing the outer surface 11 of the gel applying roller 10. In this embodiment, the scraper roller 30 is unmoved relative to the gel applying roller 10. The scraper 32 is formed on the outer surface of the main body 31 along the axis of the main body 31, and the length L1 of the scraper 32 corresponds to the length L2 of the gel applying roller 10. Polyurethane gel 40 is stored between the scraper 32 and the outer surface 11 of the gel applying roller 10. The polyurethane gel 40 is in contact with the outer surface 11 of the gel applying roller 10. In use, the scraper roller 30 and the gel applying roller 10 may be pre-heated for the purpose of raising the temperature of the polyurethane gel 40 to make it become viscous liquid for clinging to the outer surface 11 of the gel applying roller 10 well. When the gel applying roller 10 is rotated counterclockwise, the polyurethane gel 40 will cling to the outer surface 11 of the gel applying roller 10, and the scraper 32 of the scraper roller 30 will evenly scrape the polyurethane gel 40 covering the outer surface 11 of the gel applying roller 10, making the polyurethane gel 40 clinging to the outer surface 11 of the gel applying roller 10 uniform in thickness. It should be mentioned that during the rotation of the gel applying roller 10, the scraper 32 will be maintained with a tiny distance from the outer surface 11 of the gel applying roller 10 or slightly contact the outer surface 11 of the gel applying roller 10, enabling the polyurethane gel 40 to be distributed between the dimples 12 uniformly, thereby ensuring the uniform thickness of the polyurethane gel 40 clinging to the outer surface 11 of the gel applying roller 10.

The aforementioned step b) of applying polyurethane gel to a mesh fabric base material by the gel applying mechanism is primarily conveying a mesh fabric base material 60 to pass between the gel applying roller 10 and the drive roller 20, making the polyurethane gel 40 clinging to the gel applying roller 10 applied to one side 61 of the mesh fabric base material 60. Specifically speaking, the gel applying mechanism 2 has a feeding roller 50 located below the drive roller 20 and disposed correspondingly to and separately from the drive roller 20. The mesh fabric base material 60 is rolled onto the feeding roller 50. An end of the mesh fabric base material 60 is pulled through a gap between the gel applying roller 10 and the drive roller 20, and then fixed to a receiving roller (not shown) located adjacent to the drive roller 20. The mesh fabric base material 60 is in contact with the surface of the drive roller 20. When the drive roller 20 is rotated clockwise, the drive roller 20 drives the mesh fabric base material 60 rolled on the feeding roller 50 to continuously pass between the gel applying roller 10 and the drive roller 20, making the polyurethane gel 40 clinging to the outer surface 11 of the gel applying roller 10 applied to the side 61 of the mesh fabric base material 60.

The aforementioned step c) of moisture hardening the mesh fabric base material 60 applied with the polyurethane gel at room temperature is primarily setting the mesh fabric base material 60 applied on the side 61 thereof with the polyurethane gel 40 still in an environment with specific temperature and humidity, making the polyurethane gel 40 naturally cured and hardened without being baked to become a polyurethane gel layer. Specifically speaking, after the whole side 61 of the mesh fabric base material 60 is applied with the polyurethane gel 40, the mesh fabric base material 60 is laid flat or rolled into a bundle, placed in an environment with a temperature ranged between 10° C. and 45° C. and a relative humidity ranged between 40% and 95%, and set still for at least 18 hours (preferably set still for at least 24 hours), making the polyurethane gel 40 applied on the side 61 of the mesh fabric base material 60 naturally cured and hardened in this environment to become the polyurethane gel layer. It should be additionally mentioned that the curing of the polyurethane gel 40 is reacting the functional group of the molecule of the gel with mist to bring the bridging effect. The lower the humidity during the reaction, the slower the reaction. As regards the aforementioned environment for moisture hardening at room temperature, if the temperature is lower than 10° C., the time for hardening the polyurethane gel 40 is too long to meet the production efficiency and cost. If the temperature is higher than 45° C., it is helpful for shortening the time for hardening the polyurethane gel 40, but it may need an additional temperature control mechanism for raising the environmental temperature and thus will be increased in cost by additional energy consumption, thereby lowering the effect of energy saving and carbon reduction.

Besides, if the relative humidity is lower than 40%, it will decelerate the bridging reaction of the reactive group inside the polyurethane gel 40, prolonging the time for hardening the polyurethane gel 40, but it may need an additional humidity control mechanism for raising the environmental humidity and thus will be increased in cost by additional energy consumption, thereby affecting the effect of energy saving and carbon reduction. If the relative humidity is higher than 95%, the time for hardening the polyurethane gel 40 will be highly shortened, but it will cause quality problem, such as the mesh fabric base material 60 being damped, bringing an additional need for drying apparatus to dry up the mesh fabric base material 60, which additionally consumes energy and increases the cost.

Summarizing the considerations such as the effect of energy saving and carbon reduction, the time for hardening and curing (related to the production efficiency and cost) and the hardening and curing extent (affective to the product quality such as the possibility of storage by winding, the color fastness, the tactile impression of the product, the structural strength and so on), the inventors have experimented repeatedly for many times and the result shows that it is preferable to set the mesh fabric base material 60 applied with the polyurethane gel 40 still in the aforementioned environment with the temperature ranged between 10° C. and 45° C. and the relative humidity ranged between 40% and 95% for at least 18 hours, more preferable to set it still in the environment with the temperature ranged between 15° C. and 40° C. and the relative humidity ranged between 45% and 90% for at least 20 hours, and optimal to set it still in the environment with the temperature ranged between 20° C. and 35° C. and the relative humidity ranged between 45% and 75% for at least 24 hours.

Figure 4:
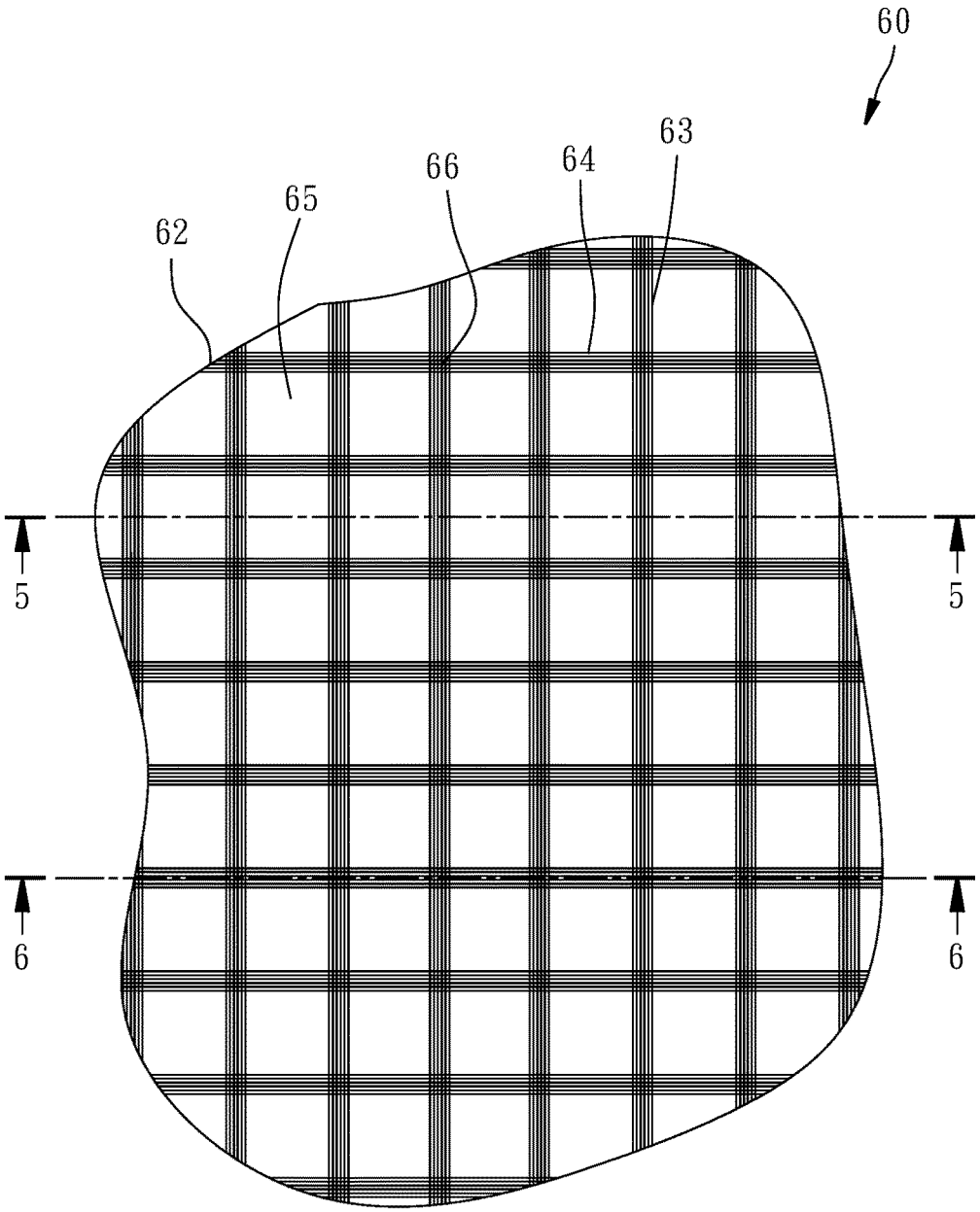
FIG. 4 is a schematic view showing that polyurethane gel covers one side of the mesh fabric base material.
Figure 5:
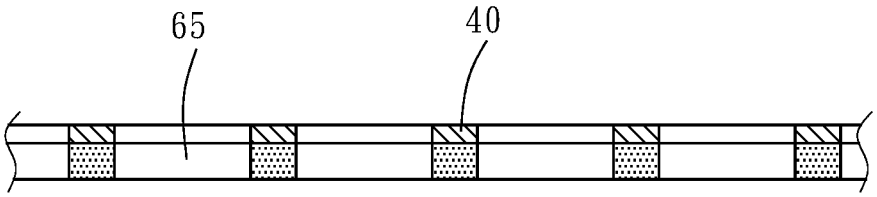
FIG. 5 is a schematic sectional view taken along the line 5-5 in FIG. 4.
Figure 6:
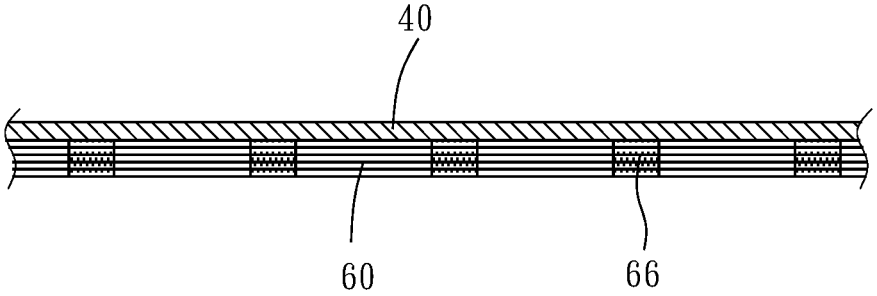
FIG. 6 is a schematic sectional view taken along the line 6-6 in FIG. 4, showing that the polyurethane gel covers one side of each of warp yarns, weft yarns and nodes between the warp yarns and the weft yarns of the mesh fabric base material.

The steps of the manufacturing method 1 of the abrasion resistant mesh fabric provided by the preferred embodiment of the present invention are specified above. By the above-described manufacturing method, the side 61 of the mesh fabric base material 60 is firmly coated with a hardened polyurethane gel layer, and thus the mesh fabric base material 60 and the polyurethane gel layer compose the abrasion resistant mesh fabric provided by the present invention. The structural features of the adopted mesh fabric base material 60 and the abrasion resistant mesh fabric will be further described in detail herein below. The mesh fabric base material 60 used in the present invention may be the mesh fabric manufactured by any kinds of size specification or any kinds of weave (knitting, plane weave). Referring to FIG. 4 to FIG. 6, the mesh fabric base material 60 instanced in this embodiment optionally has a mesh structure 62. The mesh structure 62 has a plurality of warp yarns 63, a plurality of weft yarns 64, and a plurality of holes 65 and a plurality of nodes 66, which are formed by the interlacing of the warp yarns 63 and the weft yarns 64. Besides, the polyurethane gel layer (as shown in FIG. 6) covers the periphery of each hole 65 (as shown in FIG. 5) on the side 61 of the mesh fabric base material 60 and one side of each node 66. Therefore, in the abrasion resistant mesh fabric provided by the present invention, the polyurethane gel layer covers one side of each of the warp yarns 63, the weft yarns 64 and the nodes 66 of the mesh fabric base material 60, which is helpful for making the abrasion resistant mesh fabric relatively more robust in structure and making the abrasion resistant mesh fabric relatively more uneasy to be torn and worn. Even if the adopted mesh fabric base material 60 has relatively larger holes 65 and higher breathability but has slightly low structural strength, the polyurethane gel layer covers every nodes 66, so the abrasion resistant mesh fabric is still increased in robustness of the whole structure and maintained with quite structural strength, thereby uneasy to be torn.

In conclusion, the manufacturing method 1 of the abrasion resistant mesh fabric provided by the present invention is applying the polyurethane gel 40 to cover the side 61 of the mesh fabric base material 60, and making the polyurethane gel 40 cured and hardened in normal environmental temperature and humidity conditions to become the polyurethane gel layer. The manufacturing method 1 of the abrasion resistant mesh fabric provided by the present invention doesn't need high temperature baking in the oven, but can raise the robustness of the abrasion resistant mesh fabric and make it even more abrasion resistant, not only attaining energy saving and carbon reduction, but also little affecting the color fastness of the abrasion resistant mesh fabric, hardly affecting the presentation of the color of the abrasion resistant mesh fabric. Besides, even though the warp yarns 63 and the weft yarns 64 are entirely impregnated and covered with the polyurethane gel 40, it doesn't cause structural embrittlement to the abrasion resistant mesh fabric. In addition, the polyurethane gel 40 can be applied to the side of various kinds of fabric, so the manufacturing method 1 of the abrasion resistant mesh fabric provided by the present invention has high applicability. The abrasion resistant mesh fabric provided by the present invention not only maintains its own inner structural strength and elasticity, but the abrasion resistance of the abrasion resistant mesh fabric is also increased by the polyurethane gel layer covering the side 61 of the mesh fabric base material 60, and thus the robustness of the whole structure of the abrasion resistant mesh fabric is increased, making the abrasion resistant mesh fabric uneasy to be torn.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A manufacturing method of an abrasion resistant mesh fabric, the manufacturing method comprising the steps of:

a) providing a gel applying mechanism, the gel applying mechanism having a rotatable gel applying roller, a drive roller located by one side of the gel applying roller and arranged separately from the gel applying roller, and a scraper roller located by another side of the gel applying roller and arranged separately from the gel applying roller, the scraper roller having a scraper facing an outer surface of the gel applying roller, polyurethane gel being stored between the scraper and the outer surface of the gel applying roller in a contact manner with the outer surface of the gel applying roller;

b) conveying a mesh fabric base material to pass between the gel applying roller and the drive roller in a way that the polyurethane gel clinging to the gel applying roller is applied to one side of the mesh fabric base material; and c) hardening the polyurethane gel applied on the side of the mesh fabric base material at room temperature;

wherein in the step b), when the gel applying roller is rotated, the polyurethane gel will cling to the outer surface of the gel applying roller, and the scraper of the scraper roller will evenly scrape the polyurethane gel covering the outer surface of the gel applying roller; and wherein in the step c), the mesh fabric base material applied with the polyurethane gel is set still in an environment with a temperature ranged between 10° C. and 45° C. and a relative humidity ranged between 40% and 95% for at least 18 hours.

2. The manufacturing method as claimed in claim 1, wherein in the step c), the mesh fabric base material applied with the polyurethane gel is set still in the environment for at least 24 hours.

3. The manufacturing method as claimed in claim 1, wherein the outer surface of the gel applying roller has a plurality of dimples.

4. The manufacturing method as claimed in claim 1, wherein the scraper roller has a main body; the scraper is fixed to an outer surface of the main body along an axis of the main body; a length of the scraper corresponds to a length of the gel applying roller.

5. The manufacturing method as claimed in claim 1, wherein the mesh fabric base material is rolled on a feeding roller, and driven by the drive roller to be conveyed to pass between the gel applying roller and the drive roller.

* * * * *